US005455141A

United States Patent [19]

Owczarczyk et al.

[11] Patent Number: 5,455,141

[45] **Date of Patent: * Oct. 3, 1995**

[54] PHOTOGRAPHIC ELEMENTS CONTAINING BLOCKED DYE MOIETIES

[75] Inventors: Zbyslaw R. Owczarczyk; Xiqiang Yang, both of Webster; Daniel L. Kapp, Rochester; Wojciech K. Slusarek, Rochester; Louis E. Friedrich, Rochester; David T. Southby, Rochester, all of N.Y.

[73] Assignee: Eastman Kodak Company, Rochester, N.Y.

[ * ] Notice: The portion of the term of this patent subsequent to Oct. 11, 2011 has been disclaimed.

[21] Appl. No.: 290,661

[22] Filed: Aug. 15, 1994

Related U.S. Application Data

[63] Continuation-in-part of Ser. No. 148,805, Nov. 5, 1993, Pat. No. 5,354,650, which is a continuation-in-part of Ser. No. 890,905, May 29, 1992, abandoned.

[51] Int. Cl.[6] ..... G03C 8/12; G03C 8/08; G03C 7/305; G03C 7/26

[52] U.S. Cl. ..... 430/222; 430/223; 430/543; 430/557; 430/559; 430/562; 430/955; 430/958

[58] Field of Search ..... 430/222, 223, 430/226, 202, 543, 544, 955, 957, 958, 959, 557, 562, 559

[56] References Cited

U.S. PATENT DOCUMENTS

| | | | |
|---|---|---|---|
| 3,148,062 | 9/1964 | Whitmore et al. | 430/382 |
| 3,227,554 | 1/1966 | Barr et al. | 430/382 |
| 3,880,658 | 4/1975 | Lestina et al. | 96/29 D |
| 4,234,672 | 11/1980 | Ford et al. | 430/222 |
| 4,248,962 | 2/1981 | Lau | 430/382 |
| 4,263,393 | 4/1981 | Chen | 430/218 |
| 4,310,612 | 1/1982 | Mooberry et al. | 430/223 |
| 4,343,893 | 8/1982 | Donald et al. | 430/401 |
| 4,357,853 | 8/1985 | Van de Sande et al. | 430/218 |
| 4,358,525 | 11/1992 | Mooberry et al. | 430/217 |
| 4,409,323 | 10/1983 | Sato et al. | 430/544 |
| 4,629,683 | 12/1986 | Itoh et al. | 430/390 |
| 4,684,604 | 8/1987 | Harder | 430/375 |
| 4,690,885 | 9/1987 | Yagihara et al. | 430/212 |
| 4,734,353 | 3/1988 | Ono et al. | 430/236 |
| 4,840,884 | 6/1989 | Mooberry et al. | 430/557 |
| 5,019,492 | 5/1991 | Buchanan et al. | 430/543 |
| 5,034,311 | 7/1991 | Slusarek et al. | 430/544 |
| 5,055,385 | 10/1991 | Slusarek et al. | 430/544 |
| 5,116,712 | 5/1992 | Nakamura et al. | 430/106 |
| 5,116,717 | 5/1992 | Matsushita et al. | 430/222 |
| 5,242,783 | 9/1973 | Buchanan et al. | 430/446 |
| 5,283,162 | 2/1994 | Kapp et al. | 430/544 |
| 5,354,650 | 10/1994 | Southby et al. | 430/544 |

FOREIGN PATENT DOCUMENTS

| | | |
|---|---|---|
| 0167168 | 7/1985 | European Pat. Off. . |
| 0335319 | 3/1989 | European Pat. Off. . |
| 3506805 | 9/1985 | Germany . |
| 3153236A | 10/1989 | Japan . |
| 2036994 | 10/1978 | United Kingdom . |

*Primary Examiner*—Richard L. Schilling
*Attorney, Agent, or Firm*—Peter C. Cody

[57] ABSTRACT

Photographic elements are described which contain a release compound that during photographic processing provides an imagewise distribution of a nucleophile which can react with a uniform distribution of a blocked dye moiety contained in the element to release an unblocked dye.

13 Claims, No Drawings

PHOTOGRAPHIC ELEMENTS CONTAINING BLOCKED DYE MOIETIES

CROSS-REFERENCE TO RELATED APPLICATION

This is a continuation-in-part of Ser. No. 08/148,805 filed Nov. 5, 1993, now U.S. Pat. No. 3,354,650 which is a continuation-in-part of Ser. No. 07/890,905, filed May 29, 1992 and now abandoned. Both Ser. Nos. 07/890,905 and 08/148,805 are incorporated herein by reference.

FIELD OF THE INVENTION

This invention relates to silver halide photographic elements containing release compounds. In particular, it relates to photographic elements in which the release compounds provide an imagewise release of a dye moiety.

BACKGROUND OF THE INVENTION

Images are formed in silver halide color photographic materials by reaction between oxidized silver halide developing agent and a dye forming compound known as a coupler. It has become common practice to modify the photographic properties of the image, such as sharpness, granularity, contrast and color reproduction, by the use of an image modifying compound commonly referred to as a development inhibitor releasing (DIR) compound. Such materials were first described in U.S. Pat. Nos. 3,148,062 and 3,227,554.

In addition to development inhibitors, other photographically active groups may desirably be released during photographic processing. Such groups include development accelerators, bleach accelerators, bleach inhibitors, complexing agents, toners, stabilizers, etc.

Photograpically active groups typically are released during the development step in an imagewise manner. On occasion, depending upon the particular photographically active group and the purpose it is to serve, it may be desired to make available the active form of the photographically active group at a stage in the processing of the photographic element other than the development step, or in a uniform manner, or both.

Many release compounds release the photographically active group directly in its active form. This limits the use of such compounds in those situations where it is desired that the photographically active group act at a location remote from that where it is released. This is alleviated somewhat by release compounds in which the photographically active group is blocked by and released from an intervening group, commonly called a timing group, after that group is released from the carrier portion of the compound. Compounds of this type are described in U.S. Pat. Nos. 4,248,962; 4,409,323; 4,684,604; 5,034,311 and 5,055,385 and in European patent application 0 167 168.

The use of a timing group that blocks the active function of the photographically active group permits the photographically active group to diffuse away from the site where it is initially released before it is made available in the active form by removal of the blocking group. However, this still does not provide complete control over the location where the photographically active group acts. The use in a photographic element of a compound having a photographically active group in which the active site is blocked is known. For example, U.S. Pat. Nos. 4,343,893 and 4,690,885, and European Published Patent Application 0 335 319 show such compounds. However, in this type of compound the blocking group is removed during processing in a non-imagewise fashion. Thus, there is no correlation between release and imaging.

German Published Patent Application DT OS 35 06 805 describes the release of a photographically active group during photographic processing followed by modification of the photographic effect of that group by another compound released during processing, either to strengthen or weaken the effect of the originally released photographically active group. The active site of the photographically active group is present upon original release. The mechanisms and reactions which are described in this patent application for the release of photographically active groups are substantially different from those employed in the present invention for releasing dye moieties.

The use of masking couplers to correct for the unwanted absorption of image dyes is well known in the art. The masking effect is generated by the imagewise destruction of a dye which has the same hue as the unwanted absorption for which it corrects. The loss of density due to the destruction of the masking coupler offsets the unwanted gain in density due to the unwanted absorptions of the image dye in color records other than the primary color record of the image dye.

Masking couplers known in the art utilize dyes attached to the coupling site of a coupler parent. Coupling of the masking coupler with an imagewise distribution of oxidized developer causes a decrease in dye density as a result of the destruction of the dye chromophore or the release and subsequent wash out of the hydrophilic dye moiety.

In Mooberry, et al., U.S. Pat. No. 4,840,884, imagewise release of a shifted dye moiety is followed by unshifting to generate a dye of desired hue. The shifted dye is attached to the coupling site of the coupler parent, either directly or via a linking group, and is released imagewise upon reaction with oxidized developer. Unlike masking couplers, the shifted dyes are retained in the element after release.

The use of uniform distributions of filter dyes in photographic elements is also well known in the art for adjusting the spectral composition of light during exposure. Most filter dyes are removed during photographic processing. However, the removal of such dyes is typically in a non-imagewise manner.

It would be desirable to provide photographic elements in which a dye is released only after it has interacted with a nucleophile which has been released in an imagewise manner, so that the release of the dye is a function of the presence of the nucleophile. This would provide the ability to compensate for unwanted absorptions of certain image dyes, and the ability to increase color density in a given color record of a photographic element.

SUMMARY OF THE INVENTION

In accordance with the present invention, there is provided a photographic element comprising a support bearing at least one silver halide emulsion layer, the element containing:

a) a release compound that provides an imagewise distribution of a compound A, compound A being a mobile nucleophile that is released from a carrier group as a function of silver halide development; and b) a uniform distribution in at least one of the layers of the element of a compound B, compound B being a dye moiety that is blocked by a group which is displaceable by compound A;

compounds A and B being such that, under photographic processing conditions, they interact to provide an unblocked dye moiety.

By employing compounds A and B, which need to interact in order to provide an unblocked dye moiety, the present invention provides practical and effective alternatives to masking coupler technologies. The present invention also provides the opportunity to achieve increased color density in the layers of a photographic element.

DETAILED DESCRIPTION OF THE INVENTION

The dye moieties of the present invention can be either dyes or dye precursors. By dyes it is meant that the dye moieties will comprise a visible light absorbing chromophore and will thus exhibit a certain hue, even in blocked form. Shifted dye moieties that exhibit a different but visible hue from their unshifted counterparts are considered dyes for the purposes of the present invention.

Dye precursors, as used herein, are dyes whose chromophoric absorbance has been shifted outside of the visible spectrum by a shifting group. Thus, these compounds are colorless both when blocked and unblocked, and exhibit a particular hue only when the shifting group has been removed. In the present invention, it is contemplated that removal of the shifting group occurs either in a non-imagewise fashion (for instance, upon exposure to nucleophiles present in the processing solutions) or as a function of time (as in the case where the shifting group is a conventionally known timing or linking group). Suitable shifting groups are exemplified in U.S. Pat. Nos. 4,358,525 and 5,019,492.

Both dyes and dye precursors as defined in accordance with the present invention may further be bonded to a timing group(s). Such a timing group(s) may function as a ballasting group; or as a linking group to the blocking group for purposes of controlling the unblocking of the dye moiety or of facilitating the synthesis of compound B.

With regard to the foregoing characterization of dye moieties, it is contemplated that the present invention provides for at least three distinct scenarios. Compound B can comprise a blocking group and an unballasted dye, in which case compound B can be utilized in much the same manner as masking couplers are utilized. Compound B will exhibit a certain hue and, upon processing in the presence of an imagewise distribution of compound A, will unblock to release an unballasted dye that is either destroyed or washed out of the photographic element. Thus, color is retained only in areas where exposure does not occur.

Compound B can alternatively comprise a blocking group and a shifted but colored dye, or dye precursor, wherein the shifting group is not bonded to the blocking group (either directly or indirectly through a timing group). When the shifted dye or dye precursor is not ballasted other than by virtue of its attachment to the blocking group, compound B activity can resemble that of a shifted masking coupler. It can unshift in a non-imagewise manner during processing to provide a blocked unshifted dye that is retained in the photographic element. Imagewise release of compound A will then provide for the unblocking of the blocked unshifted dye to release a dye which is destroyed or is capable of washing out of the photographic element. As in the first scenario, the result of utilizing a compound B that comprises a blocking group and a shifted dye or dye precursor is the retention of color only in areas where exposure has not occurred.

Compound B can also comprise a blocking group and a ballasted shifted dye or ballasted dye precursor wherein the shifting group is bonded to the blocking group either directly or indirectly through an intervening timing group. In such instances, unblocking of the shifted dye or dye precursor will occur imagewise upon interaction of compound B with compound A. Unshifting of the shifted dye or dye precursor to provide a ballasted dye that is retained in the photographic element can then occur. This scenario provides an alternative means by which to obtain an increased dye density in the exposed regions of a photographic element.

The compounds A and B can be located in the same layer or in separate layers. If the compounds are in the same layer, it is possible to provide dye moieties for which stable release compounds are not available. If the compounds A and B are located in different layers, it is possible to locate compound B in a layer so as to prevent a detrimental impact of the light absorption of its dye moiety on the layer containing compound A, or other layers. Depending on the particular dye moiety that is employed, one or the other of these configurations would be preferred. Similarly, depending on the dye moiety provided and the compounds A and B, it may be desirable to have one of compounds A and B in a layer free of silver halide.

It is within the contemplation of this invention that both compound A and compound B be incorporated in the photographic element in a form which requires that they interact with a component of a processing solution before they are able to interact with each other to provide an unblocked dye moiety. In one embodiment, compound A is released imagewise as a function of silver halide development and compound B is released uniformly during processing in a form that will interact with the imagewise released compound A to provide an imagewise unblocking of the dye moiety.

In accordance with a preferred embodiment, compound A is released in an imagewise manner and compound B is present initially as a uniform distribution in a form which can interact with the imagewise released component so as to provide an imagewise unblocking of the dye moiety. Compound A, which is released, is the smaller more mobile component; and compound B, which is present as a uniform distribution, is relatively immobile.

Exemplary nucleophiles suitable for compound A are described in Chapter 13 of *Advanced Organic Chemistry,* Third Edition, J. March, published by John Wiley & Sons (1985). They include oxygen nucleophiles (alkoxide and aryloxide) and nitrogen nucleophiles (amines, azides), preferably those other than oximes; halide nucleophiles (iodide, bromide, chloride, fluoride, fluoroborate); carbon nucleophiles (cyanide, acetylide); and sulfur nucleophiles (thiols, thiocyanate, disulfide anion, and sulfinates). Preferred are aryl, alkyl and heterocyclic thiols which can be substituted with non-interfering groups such as alkyl, aryl, aralkyl, alkaryl, alkoxy, aryloxy, sulfono, amido, sulfonamido, carboxy, halo, nitro and the like.

Particularly preferred are thiol nucleophiles, such as the arylthiols represented by the structural formulas:

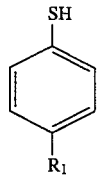

$R_1$ is $CH_3$—, $CH_3$ $(CH_2)_5$—, Cl, or $CH_3$ $(CH_2)_6O$—

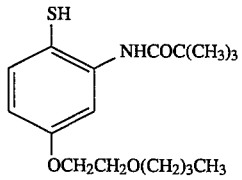

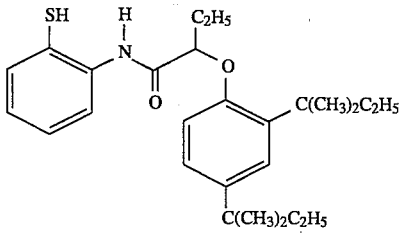

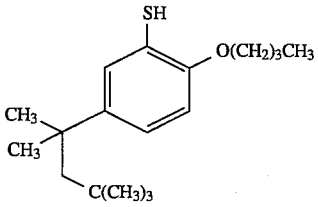

The nucleophile is part of the release compound and only made available as a nucleophile during photographic processing. Suitable release compounds contain an immobile carrier group from which the remainder of the compound is released during photographic processing.

The carrier can be an oxidizable moiety, such as a hydrazide or hydroquinone derivative, which releases the nucleophile in an imagewise manner as a function of silver halide development. Such blocking groups are described, for example, in U.S. Pat. Nos. 3,379,529 and 4,684,604.

In a preferred embodiment the carrier is a coupler moiety to whose coupling position a nucleophile is attached, so that it is coupled off by reaction with oxidized color developing agent formed in an imagewise manner as a function of silver halide development. Particularly preferred are magenta dye forming couplers, such as pyrazolones and pyrazoloazoles, and couplers which form colorless reaction products.

In any of these embodiments, a timing group can be present between the carrier and the nucleophile. Suitable timing groups are described in U.S. Pat. Nos. 4,248,962; 4,409,323, 4,684,604, 5,034,311, and 5,055,385; and European patent application 0 167 168. Examples of release compounds with preferred timing groups from which a nucleophile can be made available are shown below, where CAR is a carrier from which the remainder of the molecule is released during photographic processing and X represents the nucleophile.

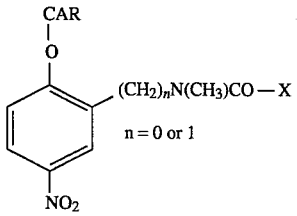

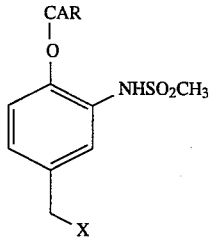

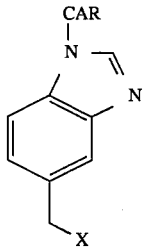

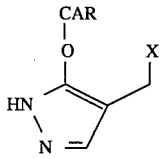

Examples of compounds that release a nucleophile, i.e. compound A, in an imagewise fashion include:

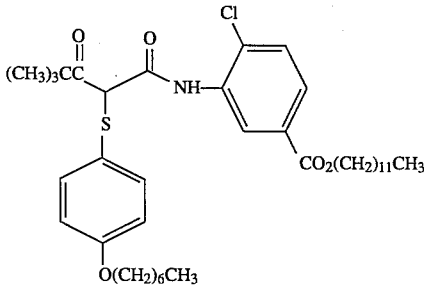

A-1

-continued
A-2
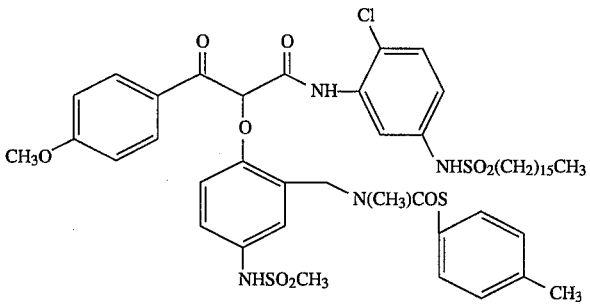
A-3
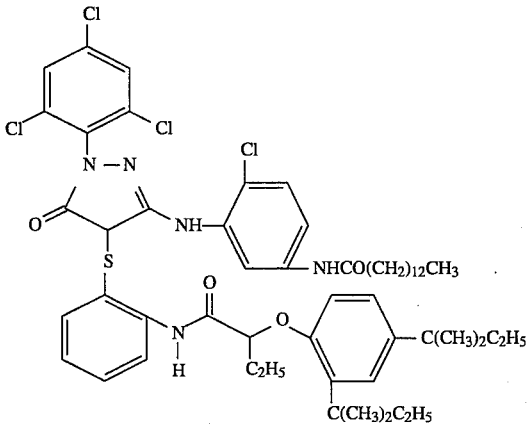
A-4
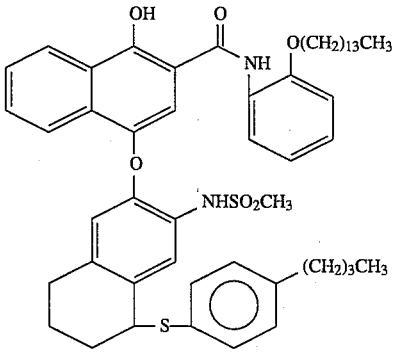
A-5
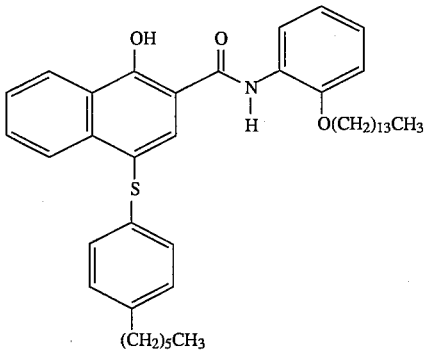

-continued
A-6
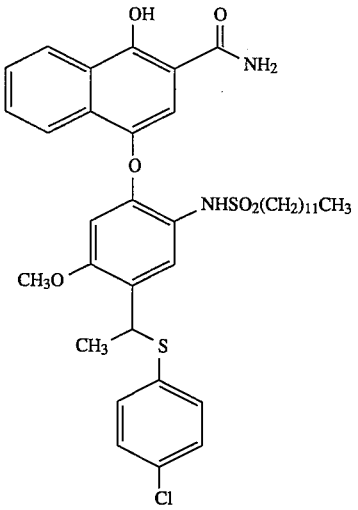
A-7
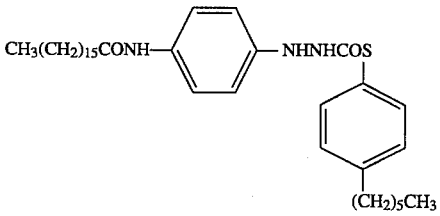
A-8
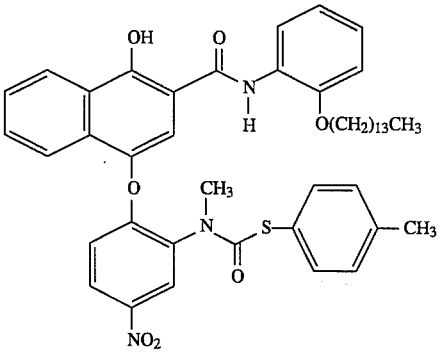
A-9
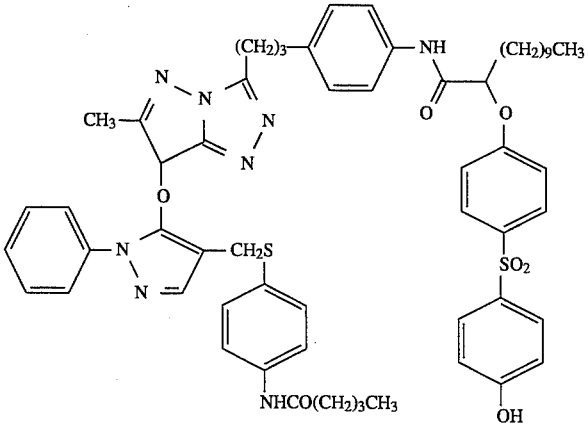

-continued
A-10
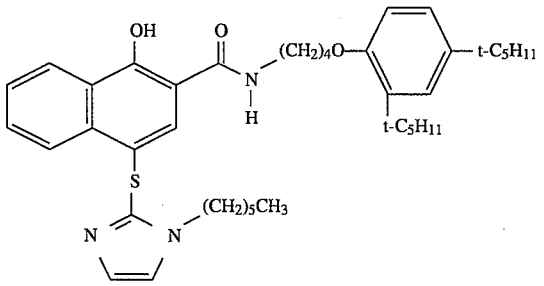
A-11
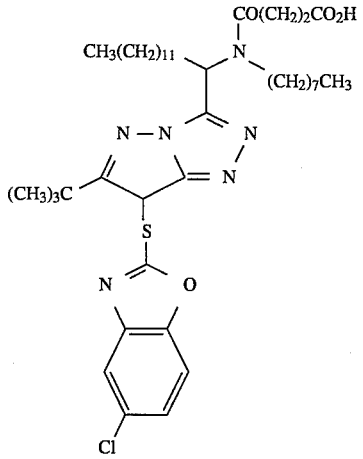
A-12
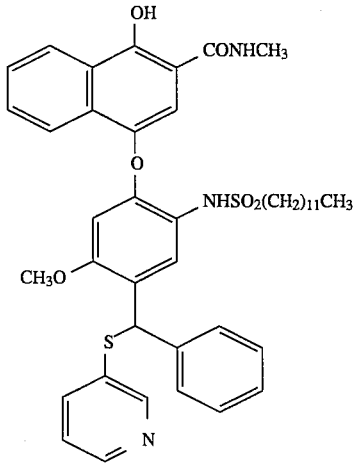
A-13
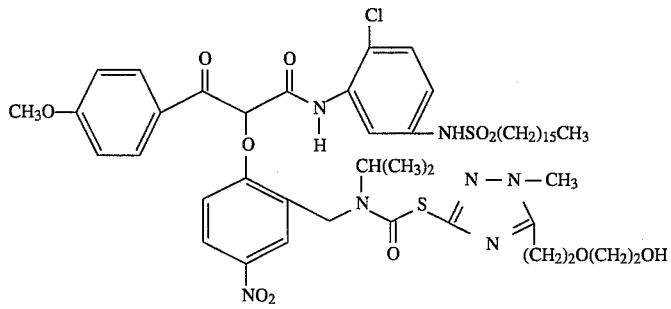

-continued

A-14

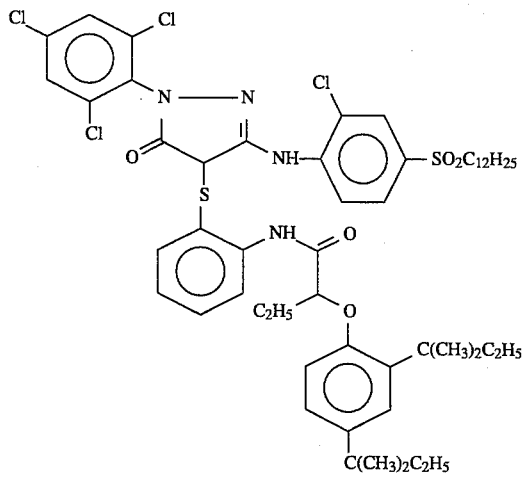

In a preferred embodiment of this invention, the nucleophile, released from the compound above, interacts with a dye moiety that is blocked by a group in such a way that only in the presence of the nucleophile will unblocking occur. Blocking groups are described below and can impart to compound B, among other things, a ballasting effect. In certain instances, the blocking groups can also serve as shifting groups. Examples of groups which are capable of undergoing an exchange reaction with nucleophiles are silylethers, disulfides, esters, amides, activated alkenes, and activated arenes.

Preferred compounds of this type, i.e. compound B, can be represented by the following structural formula:

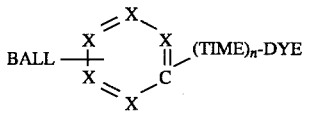

wherein:

X is N or C—R;

R is H or a monovalent substituent;

BALL is a ballast group which renders the compound immobile in the layer in which it is coated;

TIME is a timing group;

n is 0, 1 or 2; and

DYE is a dye moiety.

Other preferred compounds (B) of this type are represented by the structural formula:

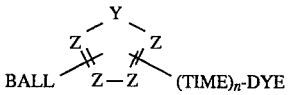

wherein:

Y is O, S, or N—R;

Z is N or C—R;

R is H or a monovalent substituent;

BALL is a ballast group which renders the compound immobile in the layer in which it is coated;

TIME is a timing group;

n is 0, 1, or 2; and

DYE is a dye moiety.

In both of the above-described structures, it is also specifically contemplated that the ballast group be attached, not to the five or six membered ring, but rather to the timing group, when present, or the dye moiety.

Suitable timing groups and photographically active groups have been described above by reference to U.S. patents and published applications, the disclosures of which are incorporated herein by reference.

Suitable R groups include hydrogen, halogen, alkyl, aryl, carboxy, amido, sulfonamido, nitro, cyano, fluoro, fluoroalkyl, fluorosulfonyl, sulfonamido, amino sulfonyl, alkylsulfonyl, aryl sulfonyl, alkylcarbonyl, arylcarbonyl, carboxyalkyl, carboxyaryl and the like.

Representative compounds that are useful in this invention as compound B include the following:

B-1
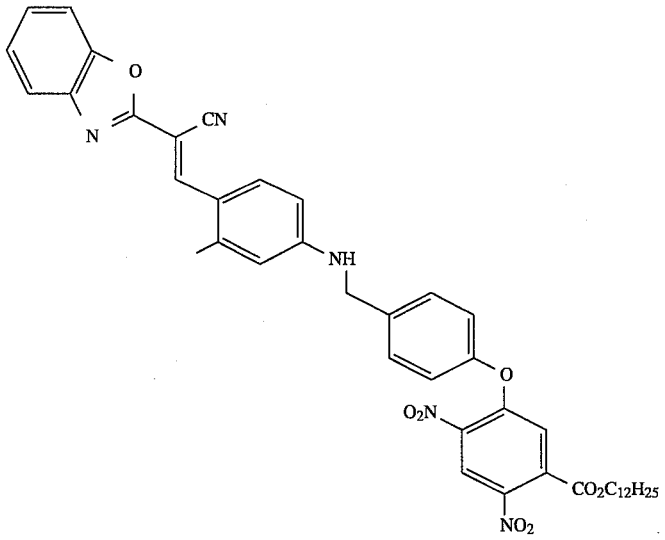
B-2
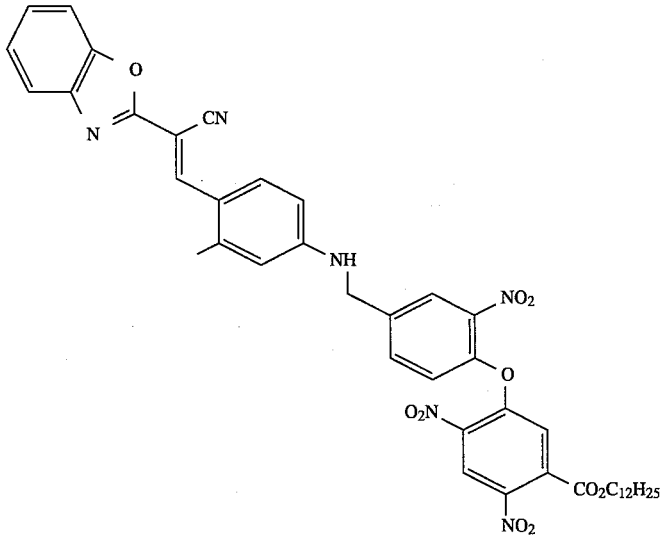

-continued
B-3
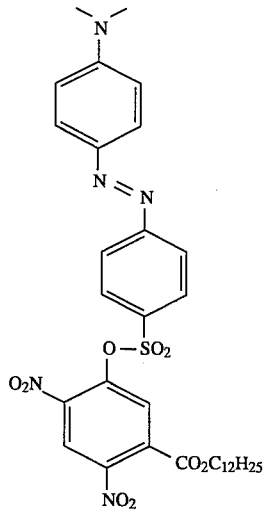
B-4
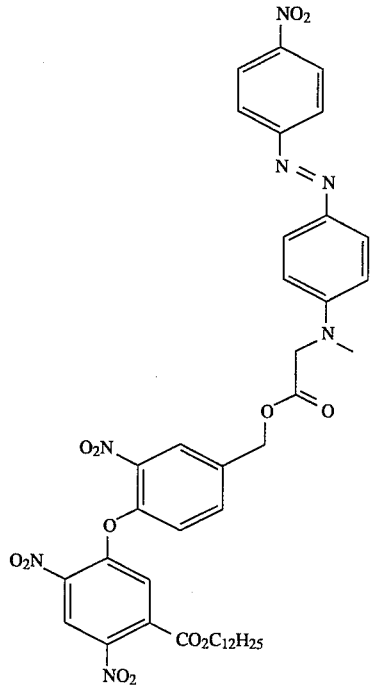
B-5
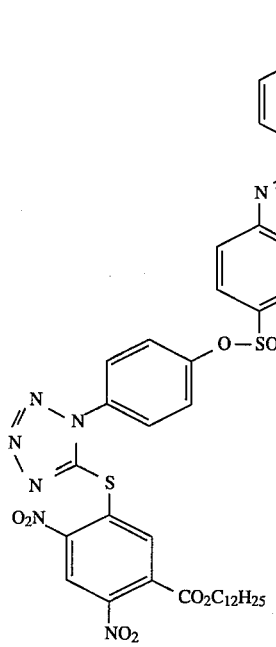
B-6
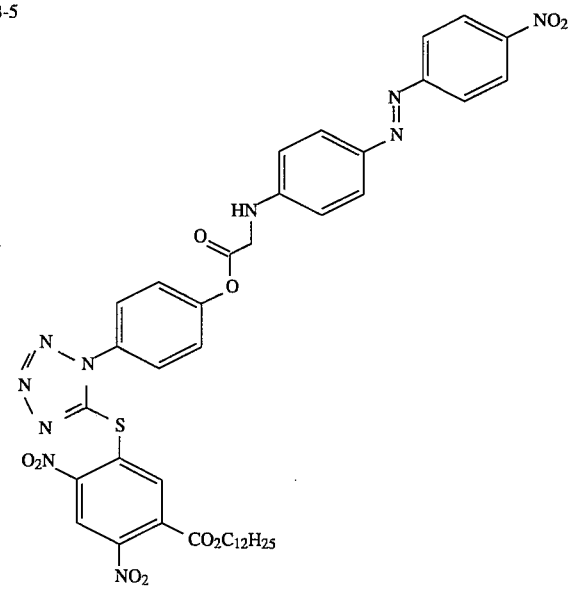

-continued
B-7
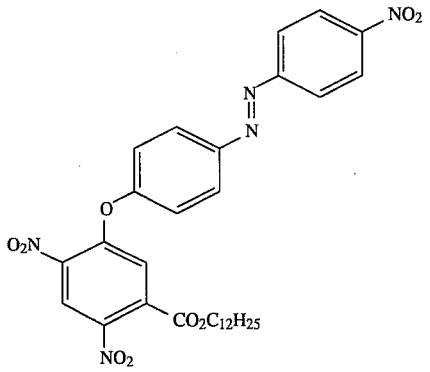
B-8
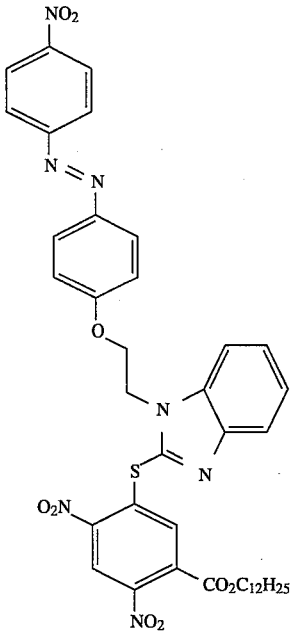
B-9
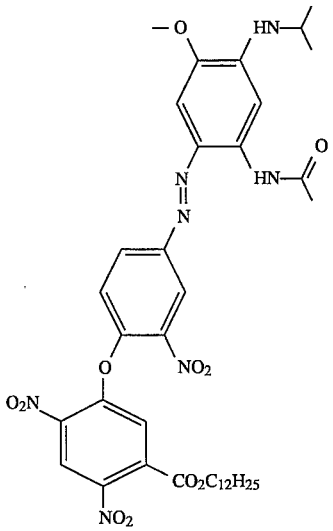
B-10
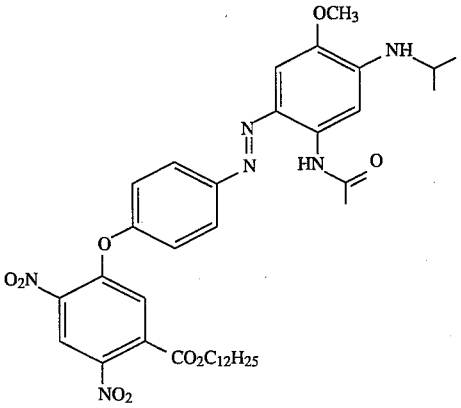
B-11
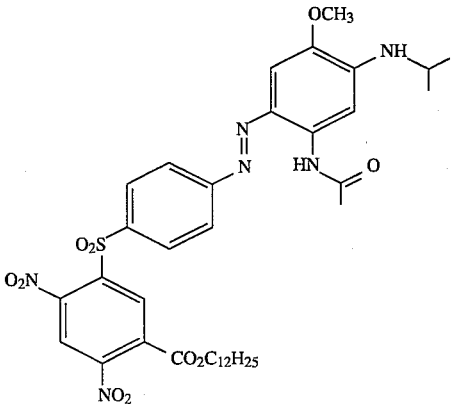
B-12
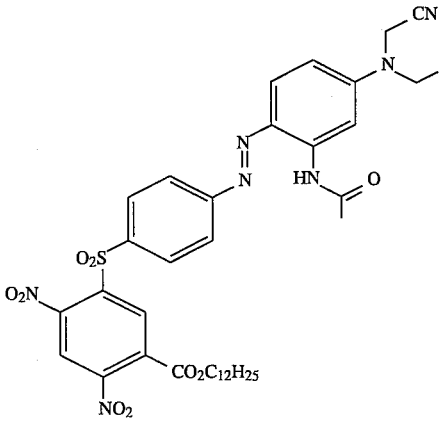

-continued
B-13
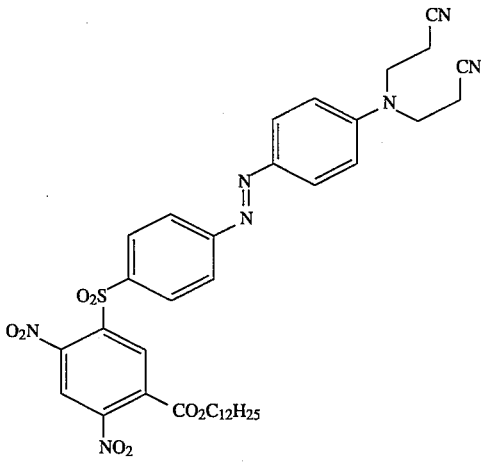
B-14
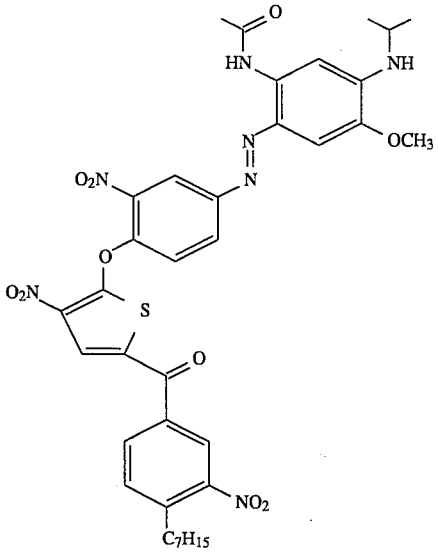
B-15
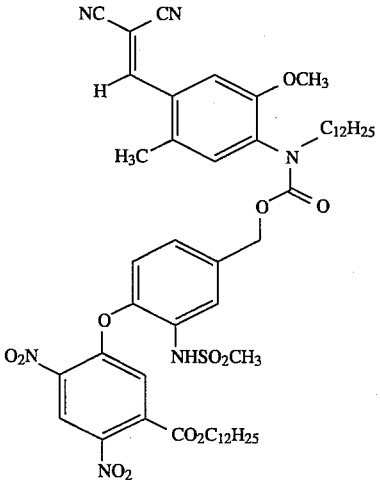
B-16
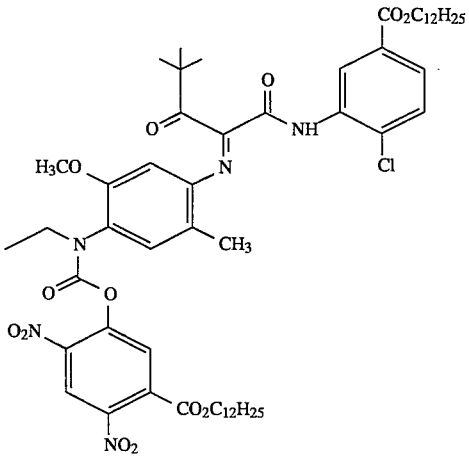
B-17
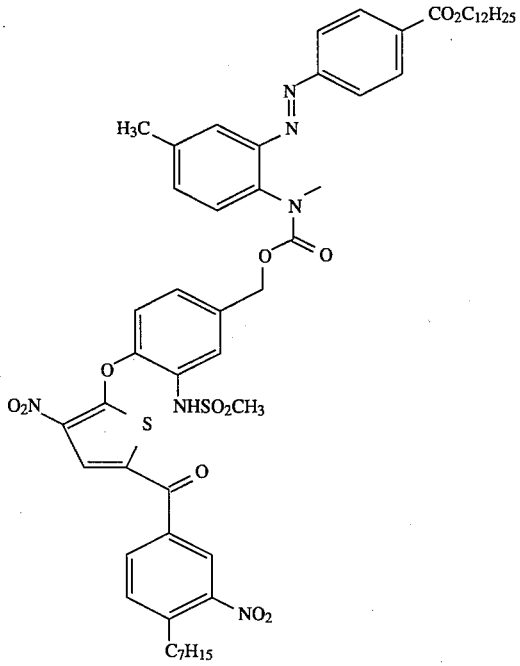
B-18
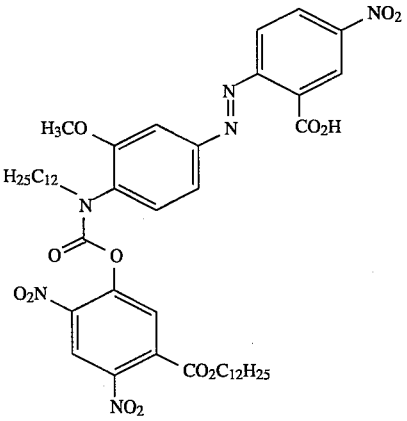

-continued

B-19

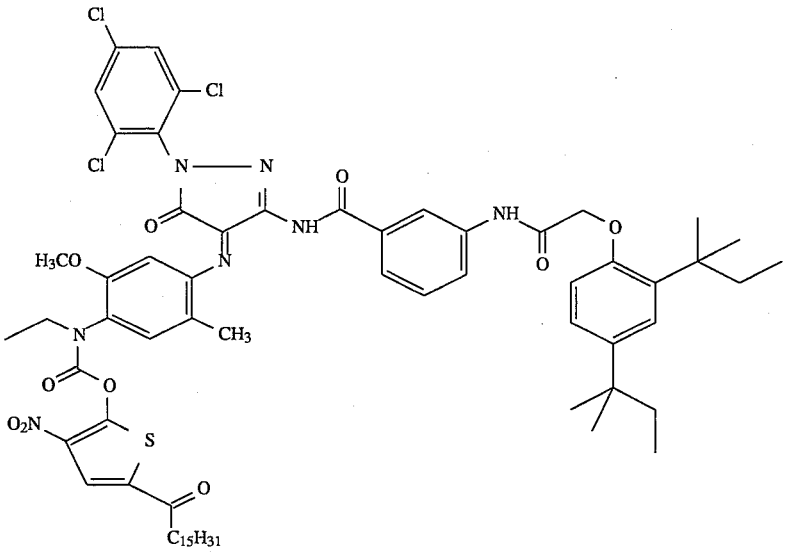

B-20

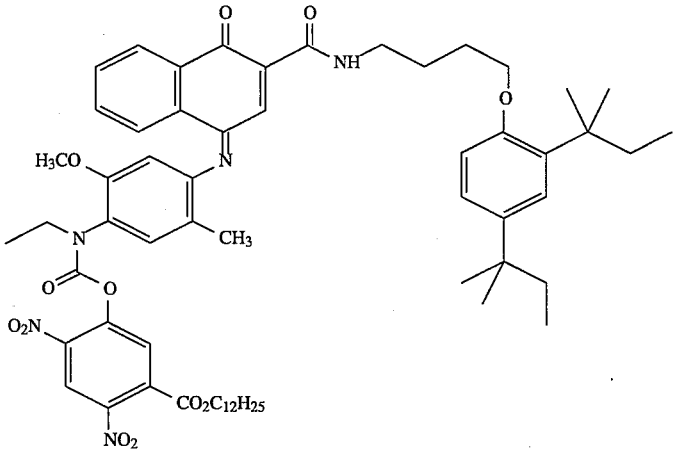

B-21

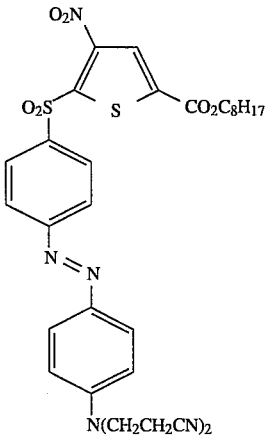

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The compounds A and B, or their precursors, can be contained in one or more of the layers of the element where they will be able to interact with one another during photographic processing.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in *Research Disclosure*Sections I and II and the publications cited therein. Suitable vehicles for the emulsion layers and other layers of elements of this invention are described in *Research Disclosure* Section IX and the publications cited therein.

In addition to the couplers generally described above, the elements of the invention can include additional couplers as described in *Research Disclosure* Section VII, paragraphs D, E, F and G and the publications cited therein. These couplers can be incorporated in the elements and emulsions as described in *Research Disclosure* Section VII, paragraph C and the publications cited therein.

The photographic elements of this invention or individual layers thereof, can contain brighteners (see *Research Disclosure* Section V), antifoggants and stabilizers (See *Research Disclosure* Section VI), antistain agents and image dye stabilizers (see *Research Disclosure* Section VII, paragraphs I and J), light absorbing and scattering materials (see *Research Disclosure* Section VIII), hardeners (see *Research Disclosure* Section IX), plasticizers and lubricants (See *Research Disclosure* Section XII), antistatic agents (see *Research Disclosure* Section XIII), matting agents (see *Research Disclosure* Section XVI) and development modifiers (see *Research Disclosure* Section XXI).

The photographic elements can be coated on a variety of supports as described in *Research Disclosure* Section XVII and the references described therein.

The compounds of this invention can be used to provide effects for which dyes have been used in the past. Reference will be made to exemplary ways in which preferred dye moieties can be employed.

When the compounds are utilized to provide for a masking effect in the photographic element, they can be employed as described, for example, in *Research Disclosure* Section VII, paragraph G. They can be contained in, or can be in reactive association with, one or more of the silver halide emulsion units in a color photographic element. If the silver halide emulsion unit is composed of more than one layer, one or more of such layers can contain the compounds of this invention. The layers can contain photographic couplers conventionally used in the art. If the carrier group of compound A of this invention is a coupler, it can form dyes of the same color as the color forming coupler(s) in the layer or unit; it can form a dye of a different color; or it can result in a colorless or neutral reaction product. Scavenger layers can be in various locations in an element containing couplers of this invention. They can be located between layers, between the layers and the support, or over all of the layers.

When the compounds are utilized to provide additional dye density in exposed regions of the photographic element, they can be employed in the ways described in U.S. Pat. No. 4,840,884, which is incorporated herein by reference.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The release and/or unblocking of compounds A and B generally is expected to occur during the development step. However, it is within the contemplation of the invention that release and/or unblocking occur during another processing step, if it is desired that the dye moiety not be made available until that step.

Examples

The following Example illustrates the synthesis of a representative compound B useful in the invention.

Preparative Example

Preparation of Compound (B-21)

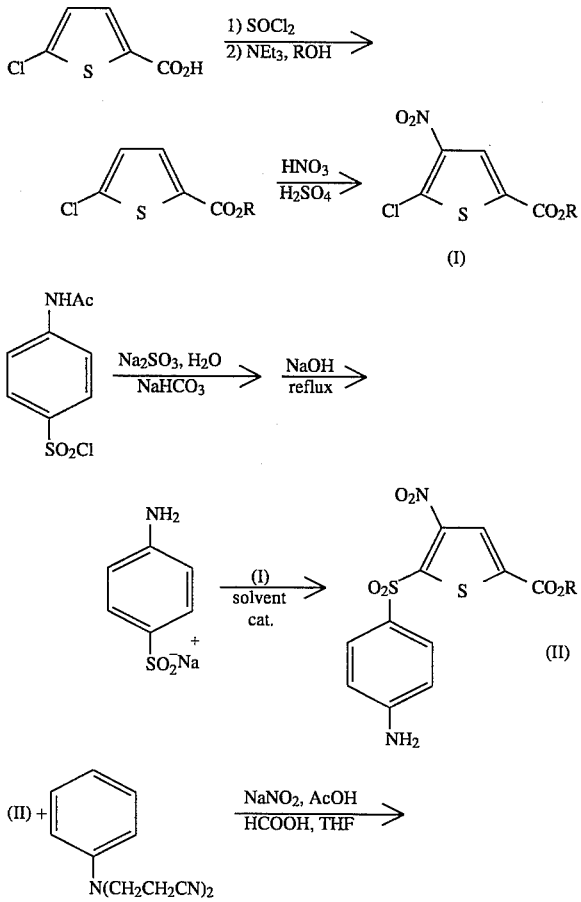

-continued

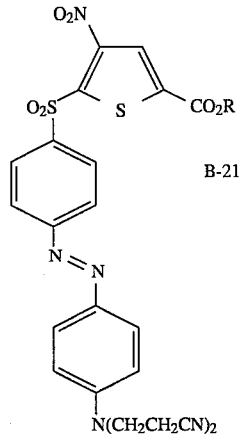

B-21

R = n-$C_8H_{17}$

Preparation of Compound (I)

A mixture of 5-chloro-2-thiophenecarboxylic acid (1.63 g, 10 mmol), toluene (5 mL) and 2 drops dimethylformamide (DMF) was treated with $SOCl_2$ (1.10 mL). After being stirred at 65° C. for 6 hours, all volatiles were removed under reduced pressure and the residue was dissolved in tetrahydrofuran(THF) (5 mL). This solution was added at 5° C. to a stirred solution of n-octanol (1.24 g, 9.5 mmol) and pyridine (0.91 mL, 11.5 mmol) in THF (10 mL). Afterwards the stirring was continued at room temperature for 2 hours and then the mixture was worked up with water and ethyl acetate prior to drying and concentration. The crude ester was subjected to nitration at 0° C. for 10 minutes using fuming nitric acid (0.44 mL, 10.5 mmol) and sulfuric acid (12 mL). The typical work up procedure using water and ethyl acetate was used to isolate the crude product (I) as an yellow oil (2.66 g, 83%). The structure of (I) was confirmed by $^1$H-NMR.

Preparation of Compound (II)

To a vigorously stirred mixture of sodium sulfite (2.65 g, 21 mmol), sodium bicarbonate (3.61 g, 43 mmol), tetrabutylammonium bromide (97 mg,0.3 mmol), water (15 mL) and dichloromethane (15 mL) was added over a period of 15 minutes N-acetylsulfanilyl chloride (2.33 g, 10 mmol) at ca. 50° C. Afterwards the stirring was continued for 2 hours and dichloromethene was removed under water aspirator pressure. The residue was treated with water (5 mL) and sodium hydroxide (2.40 g, 60 mmol) and heated at reflux for 10 hours. After that, the mixture was cooled to room temperature follow by addition of 6N hydrochloric acid to bring pH to ca. 10, warmed up to 50° C. and treated with a solution of (I) (2.56 g, 8 mmol) and tetrabutylammonium bromide (97 mg, 0.3 mmol) in dichloromethane (7 mL). After being vigorously stirred for an additional 20 minutes the mixture was cooled to room temperature, diluted with water (70 mL) and dichloromethane (40 mL); the organic layer was separated, washed with water (100 mL) and dried over sodium sulfate. Removal of solvents provided 3.34 g (97%) of (II); mp: 94°–97° C.

Preparation of Compound (B-21)

To a mixture of (II) (1.29 g, 3 mmol), acetic acid (10 mL), formic acid (2 ml) and THF (5 mL) was added at 20° C. a solution of sodium nitrite (0.248 g, 3.6 mmol) in 2 mL of water. After being stirred for 20 minutes the mixture was treated with 50 mg of urea follow by addition of N,N-di(2-cyanoethyl)aniline (0.598 g, 3 mmol) in acetic acid (5 mL). The resulting mixture was stirred for 6 hours and diluted with water (10 mL). The precipitated solid dye was isolated through filtration and recrystalized from the mixture of ethanol and ethyl acetate to give 1.13 g (58%) of B-21 as an orange solid. Spectral and elemental analysis confirmed that the compound was B-21.

Example

Photographic elements were prepared by coating the following layers on a cellulose ester film support (the number following a component indicates the amount of the component contained in the layer, in mg/m$^2$).

Emulsion Layer:
- Gelatin-3770;
- Green Sensitized silver bromoiodide (as Ag)-1076;
- Magenta image coupler A-3 dispersed at equal weight with a 7:3 mixture of tritolylphosphate and 2-butoxy-N,N-dibutyl-5-(1,1,3,3-tetramethylbutyl)-benzenamine-672; Compound of Table I codispersed with the image coupler.

Protective Overcoat:
- Gelatin-2690;
- Bisvinylsulfonylmethyl ether at 1.75% total gelatin.

Strips of each element were exposed to green light through a graded density step tablet, and then developed for 3.25 minutes at 38° C. in the following color developer. Each strip was stopped, washed, bleached, fixed, washed and dried.

| Color Developer: | |
|---|---|
| Distilled water | 800 ml |
| Sodium Metabisulfite | 2.78 g |
| Sodium Sulfite, anhydrous | 0.38 g |
| CD-4 (color developer)* | 4.52 g |
| Potassium Carbonate, anhyd. | 34.3 g |
| Potassium Bicarbonate | 2.32 g |
| Sodium Bromide | 1.31 g |
| Potassium Iodide | 1.20 mg |
| Hydroxylamine Sulfate (HAS) | 2.41 g |
| Diethylenetriaminepentacetic acid, pentasodium salt (40% Soln.) | 8.43 g |
| Distilled water | to 1 L |

*CD-4 is 4-amino-3-methyl-N-ethyl-N-beta-hydroxy-ethylaniline sulfate.

Processed images were read for green and blue density at minimum and maximum exposure. The results in Table I show that in the presence of A-3 and B-21, the unwanted blue density of the magenta image dye has been corrected.

TABLE I

| | Compound | Density at Minimum Exposure | | Density at Maximum Exposure | |
|---|---|---|---|---|---|
| Element | (mmoles/sq.m) | Blue | Green | Blue | Green |
| Comparison | none | 0.05 | 0.19 | 0.46 | 2.68 |
| Invention | B-21 (10.8) | 0.49 | 0.27 | 0.49 | 2.78 |

For comparison purposes, a similar experiment was run using a non-blocked dye. DYE-1 is the (4-(dibutylamino)phenyl)methylene-propanedinitrile. In this experiment the coated level of magenta image coupler A-3 was 491 mg/sq.m.

TABLE II

| Element | Compound (mmoles/sq.m) | Density at Minimum Exposure Blue | Density at Minimum Exposure Green | Density at Maximum Exposure Blue | Density at Maximum Exposure Green |
|---|---|---|---|---|---|
| Comparison | none | 0.06 | 0.21 | .49 | 1.94 |
| Comparison | DYE-1 (21.6) | 0.79 | 0.22 | 1.28 | 1.99 |

As can be seen in the above example, incorporation of a yellow dye without the blocking group increases the blue density both in areas of minimum and maximum exposure; no imagewise loss of blue density is observed to compensate for the unwanted absorption of the magenta dye formed.

The invention has been described in detail with particular reference to preferred embodiments thereof, but it will be understood that variations and modifications can be effected within the spirit and scope of the invention.

What is claimed is:

1. A photographic element comprising a support bearing at least one silver halide emulsion layer, the element containing:

a) a release compound that provides, as a function of development, an imagewise distribution of a compound A, compound A being a mobile nucleophile that is released from a carrier group as a function of silver halide development; and b) a uniform distribution in at least one of the layers of the element of a compound B, compound B being a dye moiety that is blocked by a group which is displaceable by compound A;

compounds A and B being such that, under photographic processing conditions, they interact to provide an unblocked dye moiety.

2. A photographic element of claim 1, wherein compound B and the compound which provides compound A are in the same layer.

3. A photographic element of claim 1, wherein compound B and the compound which provides compound A are in different layers.

4. A photographic element of claim 3, wherein one of compound B or the compound which provides compound A is in a layer free of silver halide.

5. A photographic element of claim 1, wherein the dye moiety is a shifted or unshifted dye.

6. A photographic element of claim 1, wherein the nucleophile is an aryl, alkyl or heterocyclic thiol.

7. A photographic element of claim 1, wherein compound B has the structural formula:

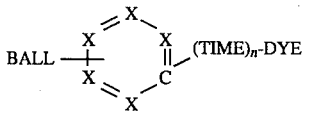

wherein:

X is N or C—R;

R is H or a monovalent substituent;

BALL is a ballast group which renders the compound immobile in the layer in which it is coated;

TIME is a timing group;

n is 0, 1 or 2; and

DYE is a dye moiety.

8. A photographic element of claim 1, wherein compound B has the structural formula:

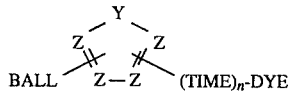

wherein:

Y is O, S, or N—R;

Z is N or C—R;

R is H or a monovalent substituent;

BALL is a ballast group which renders the compound immobile in the layer in which it is coated;

TIME is a timing group;

n is 0, 1, or 2; and

DYE is a dye moiety.

9. A photographic element of claim 1, wherein the compound which provides compound A is a pyrazolone coupler that has a thiol nucleophile in its coupling position.

10. A photographic element of claim 1, wherein compound B has the structural formula:

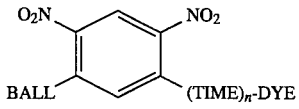

wherein:

BALL is a ballast group which renders the compound immobile in the layer in which it is coated;

TIME is a timing group;

n is 0 or 1;

DYE is a dye moiety.

11. A photographic element of claim 1 wherein compound B has the structural formula:

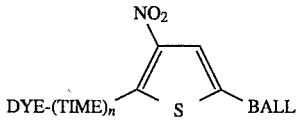

wherein:

BALL is a ballast group which renders the compound immobile in the layer in which it is coated;

TIME is a timing group;

n is 0 or 1; and

DYE is a dye moiety.

12. A photographic element of claim 1, wherein the compound which provides compound A is selected from:

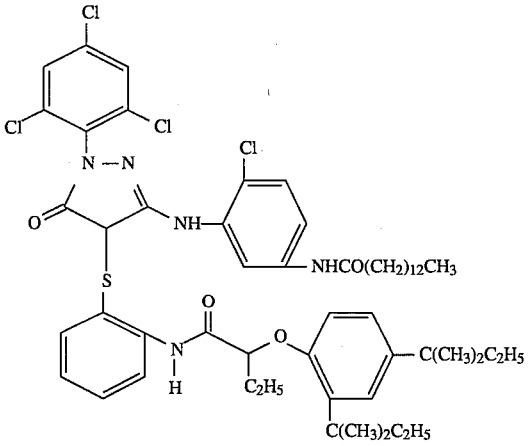
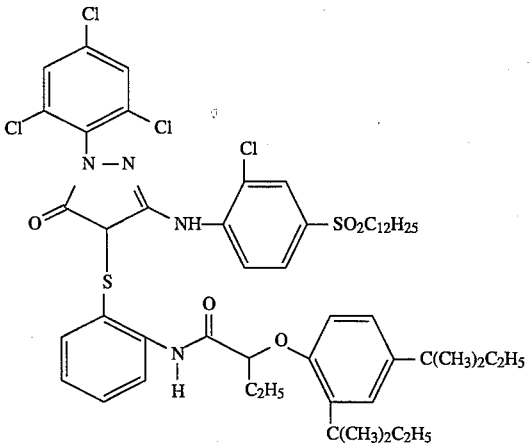
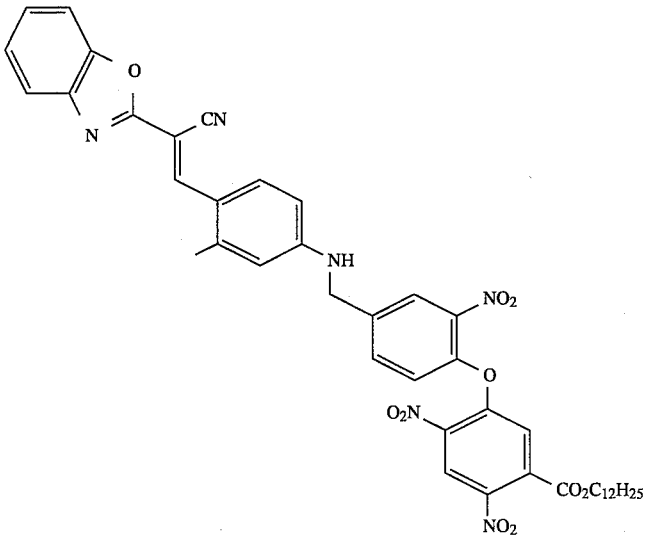
-continued
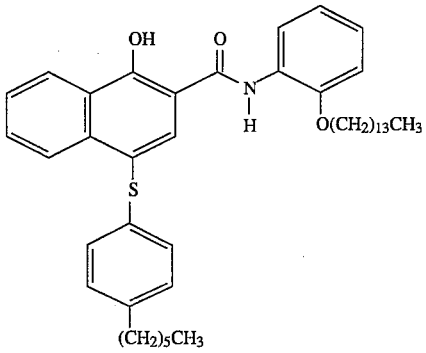
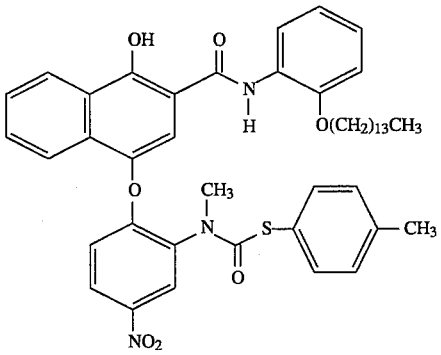
and the compound B is selected from -continued
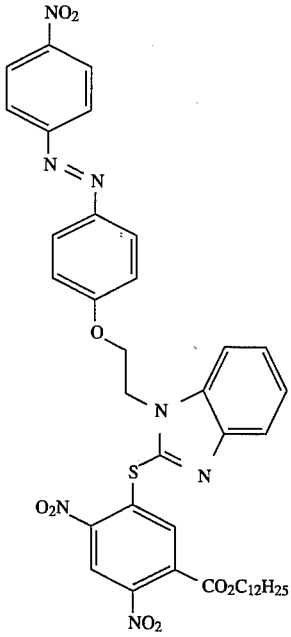
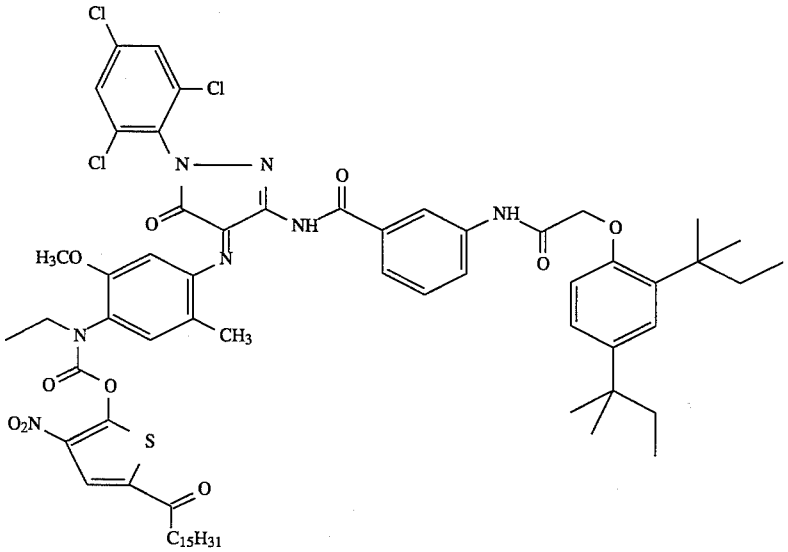
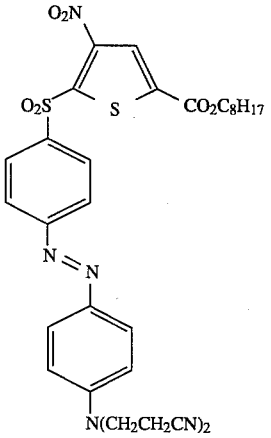

13. A photographic element comprising a support bearing at least one silver halide emulsion layer, the element containing:

a) a release compound that provides, as a function of development, an imagewise distribution of a compound A that is a nucleophile other than an oxygen or amine nucleophile; and b) a uniform distribution in at least one of the layers of the element of a compound B, compound B being a dye moiety that is blocked by a group displaceable by compound A;

compounds A and B being such that, under photographic processing conditions, they interact to provide an unblocked dye moiety.

* * * * *